United States Patent [19]

Le Guen

[11] Patent Number: 5,008,916

[45] Date of Patent: Apr. 16, 1991

[54] SAFETY DEVICE FOR RADIOGENIC UNIT

[75] Inventor: Jacques Le Guen, Paris, France

[73] Assignee: General Electric CGR S.A., Issy Les Moulineaux, France

[21] Appl. No.: 521,700

[22] Filed: May 10, 1990

[30] Foreign Application Priority Data

May 10, 1989 [FR] France ..... 8906095

[51] Int. Cl.[5] ..... H05G 1/54

[52] U.S. Cl. ..... 378/118; 378/200

[58] Field of Search ..... 317/117, 118, 200

[56] References Cited

U.S. PATENT DOCUMENTS

| | | | |
|---|---|---|---|
| 2,290,322 | 7/1942 | Goldfield . | |
| 3,898,465 | 8/1975 | Jaklad et al. | 250/389 |
| 4,032,788 | 6/1977 | Stege et al. . | |
| 4,386,320 | 5/1983 | La France . | |
| 4,731,807 | 3/1988 | Plessis et al. | 378/156 |
| 4,807,270 | 2/1989 | Ploix et al. | 378/146 |
| 4,810,893 | 3/1989 | Meertens | 250/385.1 |
| 4,862,489 | 8/1989 | Appelt | 378/117 |

FOREIGN PATENT DOCUMENTS

| | | |
|---|---|---|
| 0283688 | 9/1988 | European Pat. Off. . |
| 738296 | 8/1943 | Fed. Rep. of Germany . |
| 3212528 | 10/1983 | Fed. Rep. of Germany . |

*Primary Examiner*—Craig E. Church

*Attorney, Agent, or Firm*—Nils H. Ljungman & Associates

[57] ABSTRACT

The disclosure concerns X-ray tubes that are placed in a sealed casing and filled with a cooling liquid. The disclosed safety device is constituted by a thermostat and/or a pressure-sentitive switch, series connected in the power supply circuit of the filament of the cathode. In the case of a cathod with two filaments, the thermostat and/or the pressure-sensitive switch is or are connected to the common conductor. Thus, should a temperature or pressure threshold be exceeded, the supply to the filament is cut off, thus cutting-off the X-radiation.

6 Claims, 2 Drawing Sheets

SAFETY DEVICE FOR RADIOGENIC UNIT

BACKGROUND OF THE INVENTION

1. Field of the Invention

The invention concerns radiology instruments and, more particularly, in such instruments, a safety device for the radiogenic unit comprising the X-ray source (the tube) and the means providing protection against ionizing rays and electric shocks.

2. Description of the prior Art

X-ray tubes, for medical diagnosis for example, are generally set up like a diode, namely with a cathode and an anode or anti-cathode, these two electrodes being enclosed in a vacuum-sealed envelope that enables electrical insulation to be set up between these two electrodes. The cathode produces a beam of electrons and the anode receives these electrons on a small surface which constitutes a focus or target from which the X-rays are emitted.

When the high supply voltage is applied to the terminals of the cathode and the anode, so that the cathode is at the negative potential, a current known as an anode current is set up in the circuit, through a generator producing the high supply voltage. The anode current flows through the space between the cathode and the anode in the form of a beam of electrons which impinge on the target.

A small proportion of the energy dissipated to produce the electron beam is converted into X-rays. The rest of this energy is converted into heat. Thus, in view also of the high instantaneous power values (in the range of 100 kw) brought into play and the small dimensions in the range of one millimeter) of the target, manufacturers have long been making rotating-anode X-ray tubes where the anode is made to rotate to distribute the thermal flux on a ring called the focal ring, having a far greater area than the focus, the usefulness thereof being all the greater as the rotational speed is high (generally between 3,000 and 12,000 rpm).

The standard type of rotating anode has the general shape of a disk with an axis of symmetry around which it is made to rotate by means of an electric motor. The electric motor has a stator located outside the envelope of the X-ray tube and a rotor which is mounted within this envelope and positioned along the axis of symmetry. The rotor is mechanically fixed to the anode by means of a supporting shaft.

The energy dissipated in a tube of this kind is high and there is therefore provision for cooling it. To this end, the tube is enclosed in a casing wherein a cooling fluid, notably oil, is made to circulate. The fluid itself is cooled in a heat-exchanger which may be of the air or water type. Thus, a cooling device that works permanently has been made. However, the X-ray tube emits only intermittently so that the dissipated energy is substantial during the examination stage itself, which lasts some from a few seconds to a few some minutes, and it is practically null for the time during which no patient is examined. The result thereof is major disparities in the quantity of heat to be removed, depending on the phase considered. This leads to major variations in the temperatures of the materials used for the tube. These variations may hamper the proper working of the tube.

The oil contained in the casing is thus subjected to increases in temperature which have the effect of an expansion in the volume of oil and, consequently, an excess pressure within the casing. In order take this expansion into account in the normal range of operation of the tube, the casing is fitted out with a membrane which, when moving, increases or reduces the volume of the casing containing the cooling oil.

However, there may be increases in temperature and, hence, degrees of expansion that exceed those for which the expansion membrane is designed. The result of this is excess pressures which may damage the casing (for example by the tearing of the expansion membrane) or the tube (for example, by causing it to explode). Accidents such as this, apart from putting the radiology equipment out of working order, are a danger to patients and users.

Thus, to prevent such accidents, the casings are fitted out with alarm devices that detect any excessive increase in the volume of the casing, namely a shifting of the expansion membrane, and give an alarm signal, for example by means of a microswitch associated with said membrane. Other alarm devices measure the temperature or the pressure and give an alarm signal when the measured values go beyond a certain threshold. These different alarm devices, which are triggered by a variation of expansion, temperature or pressure, are often used simultaneously to reinforce the probability of detection of an abnormal working condition, and the first alarm signal that appears usually switches off the high-voltage generator for it is the main source of heat.

Despite these devices, accidents may occur for the following reasons. Firstly, all the alarm devices may be malfunctioning or out of order but this is an extremely rare possibility. Then, it may be that the generator switch device is malfunctioning and has not worked despite the alarm signal, so that the high voltage remains applied to the tube. Such a case is also very rare. Finally, a less infrequent case is the one where users neutralize the safety systems installed by the manufacturers because they feel that the triggering thresholds are too low to enable them to carry out all the series of examinations that they need.

It is an object of the present invention, therefore, to set up a safety system that acts independently of the cut-off device of the high voltage generator, thus eliminating the risks that result from the malfunctioning of the cut-off device.

Another object of the present invention is to make a safety device that cannot be neutralized by users.

SUMMARY OF THE INVENTION

The invention pertains to a safety device for a radiogenic unit of a radiology instrument comprising an X-ray tube enclosed in a casing filled with a cooling liquid, said tube having an anode supplied with a high voltage by a voltage generator and a cathode, comprising at least one filament connected to an electrical power supply circuit, wherein it includes at least one temperature-sensitive or pressure-sensitive device which is placed within the casing and series connected in the electrical power supply circuit of the cathode filament so that the electrical power supply to the filament is cut off when the temperature or the pressure goes beyond a pre-determined threshold.

The temperature-sensitive cut-off device is a thermostat and the pressure-sensitive device is a pressure-sensitive switch. It is possible to use either device or both of them series connected in the power supply circuit, thus increasing safety.

Moreover there may be provision, outside the casing, for a power supply current detection device and a voltage generator cut-off device which is controlled by the current detection device so as to cut off the voltage generator when, during normal operation, the current detector detects the fact that the electrical supply of the cathode has been cut off.

The power supply current detection device may be replace by a detector of the X-radiation emitted by the X-ray tube.

BRIEF DESCRIPTION OF THE DRAWINGS

Other features and advantages of the present invention will appear in the following description of a particular exemplary embodiment, said description being made with reference to the appended drawings, of which.

DESCRIPTION OF A PREFERRED EMBODIMENT

Figure 1:
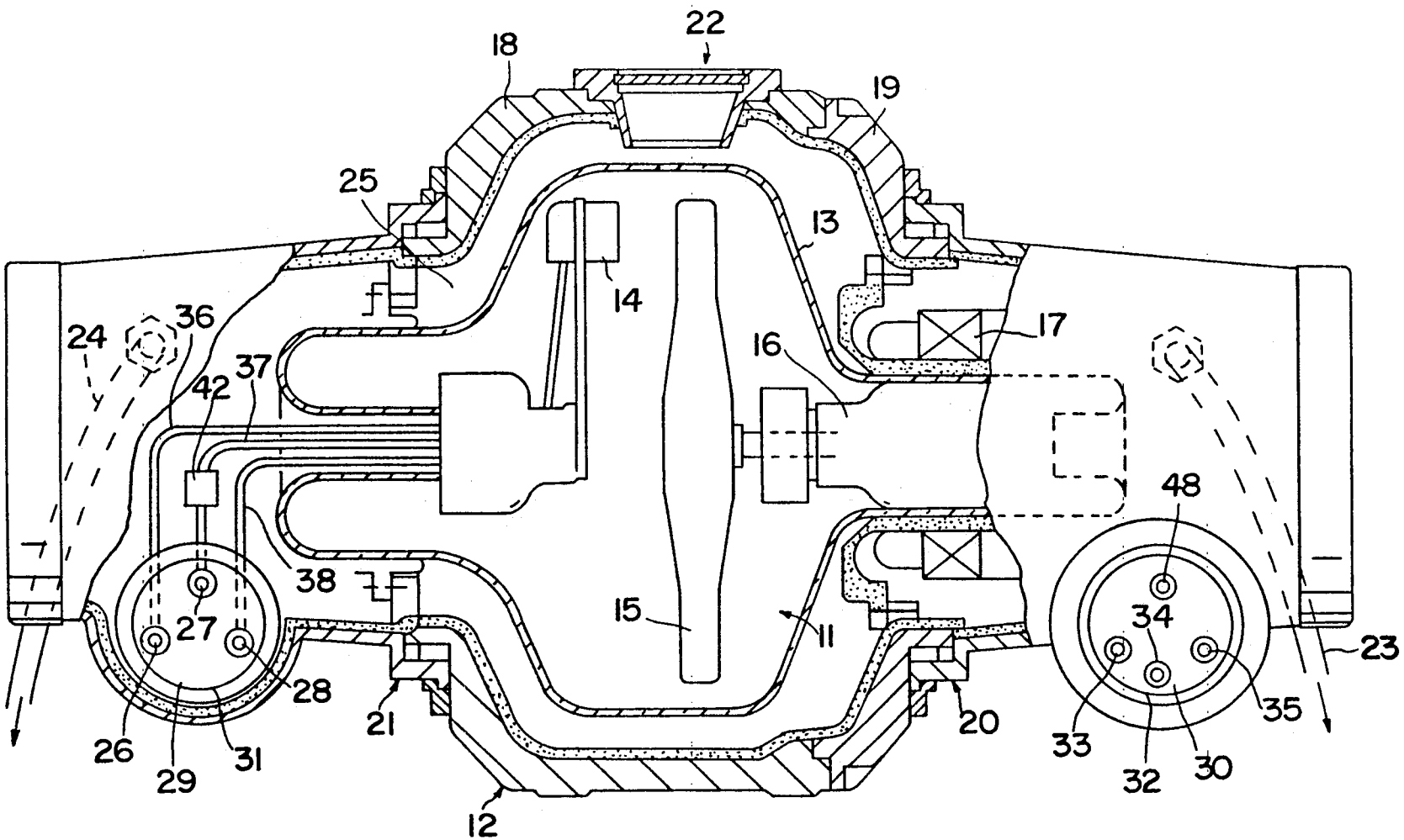
FIG. 1 is a sectional view of an X-ray tube fitted out with its protective and cooling casing.

FIG. 1 shows an X-ray tube 11 which is placed in a cooling casing 12. The X-ray tube 11 has a glass envelope 13 in which a high vacuum is set up. Inside this envelope 13 are placed an emitting cathode 14 and an anode 15 which, in this particular example, is a rotating anode. The anode 15 is mounted at the end of a rotor 16 which cooperates with a stator 17 placed outside the envelope 13.

The cooling casing 12 is made, for example, by the sealed assembly of four parts referenced 18, 19, 20 and 21. The part 18, which is substantially bears the X-radiation output window 22. The end parts 20 and 21 are closed at their ends. One of them has a cooling liquid inlet hole 23 while the other has an outlet hole 24 for this liquid. The parts 18 and 20 are connected by the part 19.

The cooling fluid flows in the space 25 between the envelope 13 and the internal walls of the casing 12 and is therefore in contact with the glass envelope 13 so as to cool it.

The electrical power supply conductors for the X-ray tube penetrate the casing 12 through the hole 29 for the cathode 14 and through the hole 30 for the anode 15. These holes 29 and 30 are fitted out with cylindrical inulating studs 29 and 30 which are sealingly mounted. These studs end within the casing by electrical terminals referenced 26, 27 and 28 for the stud 31, and 33, 34, 35 and 48 for the stud 32. Outside the casing 25, these electrical terminals are connected to the conductors of each electrical supply cable. Inside the casing 25, the electrical terminals 26, 27 and 28 are connected to the cathode 14, consisting of two filaments 39 and 40, by three electrical conductors 36, 37 and 38. Similarly, the electrical terminal 48 is connected so as to bring the rotating anode 15 to a high positive voltage with respect to the cathode which is at a negative voltage. Besides, the electrical terminals 33, 34 and 35 are connected to the stator 17 of the motor.

The safety device according to the invention consists mainly of a thermostat and/or a pressure-sensitive switch, which is series connected in the electrical power supply circuit of the cathode and which is placed inside the casing 12.

Figure 2:
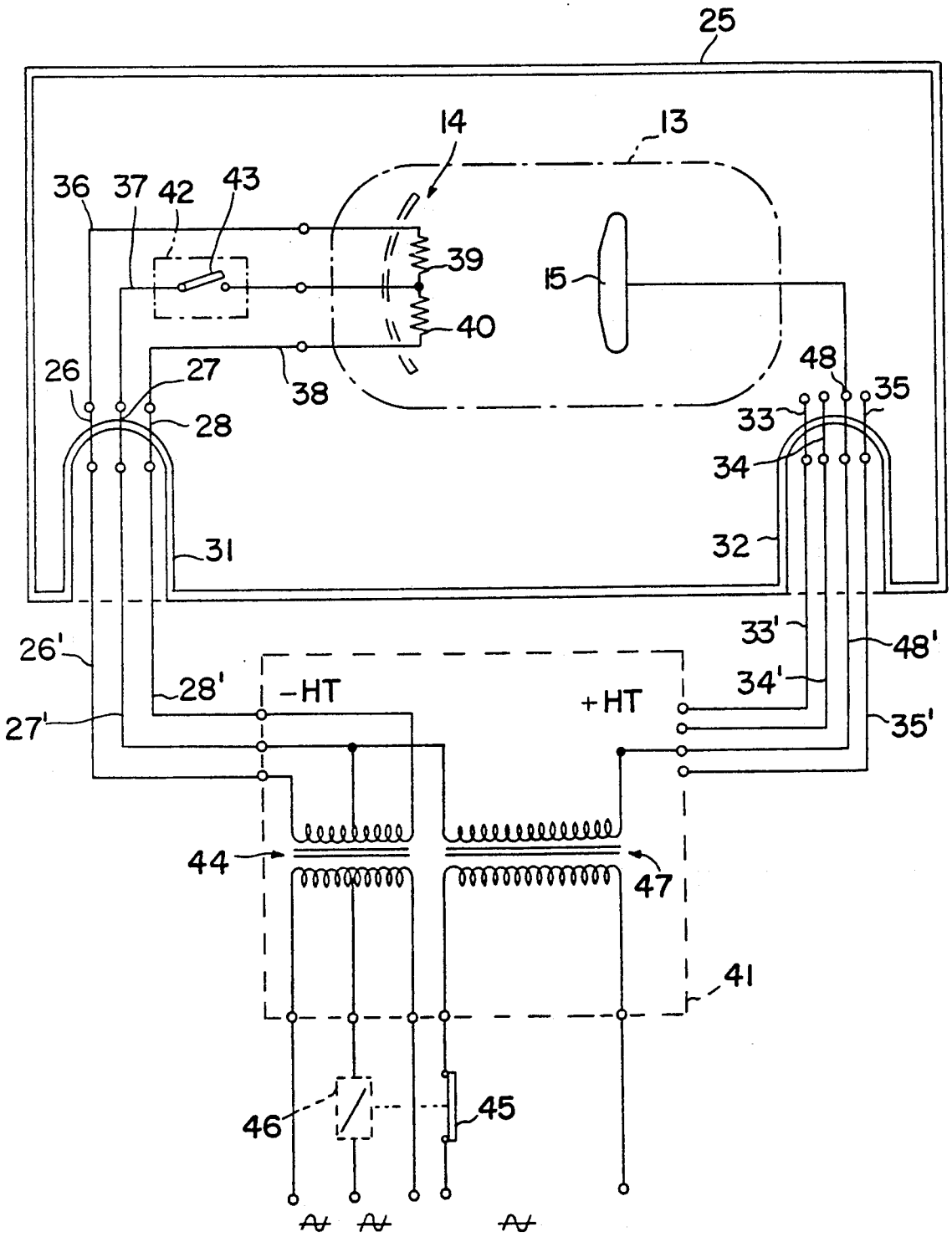
FIG. 2 is an schematic electrical diagram of a safety device according to the invention.

FIG. 2 gives a very schematic view of the main elements of the X-ray tube of FIG. 1. Identical elements have the same references in both figures. FIG. 2 also shows the electrical power supply circuit diagram of the cathode 14. Thus the cathode has two filaments 39 and 40 with their common point connected to the conductor 37 while the ends are connected to the conductors 36 and 38. As is well known, each filament is used in order to create, on the anode 15, of a focus or target which is a source of X-rays and has particular characteristics.

Outside the casing 12, the electrical terminals 26, 27 and 28, on the one hand, and 33, 34, 35 and 48, on the other hand, are respectively connected to a supply device 41 by means of conductors 26', 27' and 28' for the cathode electrical cable and 33', 34, 35' and 48' for the anode electrical cable.

According to the invention, the thermostat or the pressure-sensitive switch, referenced 42, is series connected in the common conductor 37. From the electrical point of view, it is a switch 43 that is normally closed and opens when the temperature and/or the pressure go or goes beyond a certain threshold. In mechanical terms, it is placed in the casing and borne either by the stud 31 or by the socket of the cathode.

In the example of FIG. 2, the safety device has only one element, a thermostat or a pressure-sensitive switch, but a thermostat and a pressure-sensitive switch can be connected in series so as to increase the safety should one of them be ill-operating. Moreover, when only one device is used, it is preferable that this device should be a pressure-sensitive switch because it can detect an excess pressure of cooling liquid whereas a thermostat could not detect an increase in temperature localized at any place in the casing.

The operating of the safety device according to the invention is simple: as soon as the temperature and/or the pressure goes beyond the thermostat and/or pressure-sensitive switch setting threshold, the switch 43 opens and the filament 39 or 40, is no longer power supplied. The result thereof is that there is no longer any emission of electrons or X-rays, this emission of electrons being the main source of the heating of the tube/cooling liquid/casing assembly.

Since the emission of X-rays is cut off, there is no longer any reason to maintain the high voltage on the cathode and on the anode. Thus, the invention provides for a device to detect the absence of emission of electrons and X-rays so as to cut off the high voltage generator. This detection device may consist of a detector of the cathode current, placed on the outside of the casing on the low-voltage winding of a transformer 44. In FIG. 2, it has been represented by a relay 46. If the cathode supply current is cut off during normal operation, this relay 46 actuates the cutting-off of the high voltage by means of a contact 45 placed on the low-voltage winding of a high voltage supply transformer 47.

Of course, instead of a detector of current in the power supply circuit of the cathode, it is possible to use an X-radiation detector placed on the path of the beam emitted by the tube.

The safety device according to the invention could replace the safety devices, outside the casing, that are used at present. However, it is preferable for this new safety device to be added to the earlier ones so as to form the last link in the safety system should all the other devices be malfunctioning or neutralized.

Preferably, the different thresholds for the triggering of the different safety devices should be chosen so that the devices inside the casing, namely the devices of the invention, are triggered only for higher temperature and/or pressure values than those that trigger the external devices.

The safety device that has just been described has the following advantages over existing devices:

- it does not cut off the high voltage generator at an initial stage, thus averting the risk that said generator might be cut off because of the failure of the relay;
- position inside the casing makes it inaccessible to the user and it therefore cannot be neutralized;
- it is autonomous because it does not have to be power supplied electrically through a separate circuit, and it cuts off the cathode supply current itself.

What is claimed is:

1. A safety device for a radiogenic unit of a radiology instrument comprising an X-ray tube enclosed in a casing filled with a cooling liquid, said tube having an anode and a cathode connected to a voltage generator, said cathode comprising at least one filament connected to an electrical power supply circuit, wherein it includes at least one temperature-sensitive or pressure-sensitive device which is placed within the casing and a switch, also placed within the casing, which is series connected in the power supply circuit of the cathode filament and controlled by said at least one temperature sensitive and pressure-sensitive device so that the supply of the electrical power to the filament is cut off when the temperature or the pressure goes beyond a pre-determined threshold.

2. A safety device according to claim 1, wherein the temperature-sensitive device is a thermostat.

3. A safety device according to claim 1, wherein the pressure-sensitive device is a pressure-sensitive switch.

4. A safety device according to claim 1 wherein a thermostat and a pressure-sensitive switch are series connected in the supply circuit of the cathode filament.

5. A safety device according to claim 1 further comprising a cathode supply current detector and a high voltage generator cut-off device which is controlled by said current detector so that the high voltage is no longer applied to the X-ray tube when, during normal operation of the X-ray tube, the current detector detects the fact that the supply of the electrical power to said cathode has been cut off.

6. A safety device according to claim 1, further comprising an X-radiation detector positioned on the path of the beam and a high voltage generator cut-off device which is controlled by said radiation detector so that the high voltage is no longer applied to the X-ray tube when, during normal operation of the X-ray tube, the radiation detector detects the absence of X-radiation.

* * * * *

UNITED STATES PATENT AND TRADEMARK OFFICE

CERTIFICATE OF CORRECTION

PATENT NO. : 5,008,916

DATED : April 16, 1991

INVENTOR(S) : Jacques LE GUEN

It is certified that error appears in the above-identified patent and that said Letters Patent is hereby corrected as shown below:

In the Abstract section, indicated by the INID code [57], on line 6, after 'a', delete "cathod" and insert --cathode--.

In column 1, line 66, after 'of', insert --producing--.

In column 3, line 9, delete "replace" and insert --replaced--.

In column 5, line 13, before 'position', insert --its--.

Signed and Sealed this

Fifteenth Day of September, 1992

*Attest:*

DOUGLAS B. COMER

*Attesting Officer*

*Acting Commissioner of Patents and Trademarks*